US010769972B2

(12) United States Patent
Kim

(10) Patent No.: US 10,769,972 B2
(45) Date of Patent: Sep. 8, 2020

(54) DISPLAY DRIVING DEVICE HAVING TEST FUNCTION AND DISPLAY DEVICE INCLUDING THE SAME

(71) Applicant: SILICON WORKS CO., LTD., Daejeon-si (KR)

(72) Inventor: Young Gi Kim, Daejeon (KR)

(73) Assignee: Silicon Works Co., Ltd., Daejeon-si (KR)

( * ) Notice: Subject to any disclaimer, the term of this patent is extended or adjusted under 35 U.S.C. 154(b) by 0 days.

(21) Appl. No.: 16/351,933

(22) Filed: Mar. 13, 2019

(65) Prior Publication Data

US 2019/0287443 A1 Sep. 19, 2019

(30) Foreign Application Priority Data

Mar. 14, 2018 (KR) ..... 10-2018-0029891

(51) Int. Cl.
*G09G 3/00* (2006.01)

(52) U.S. Cl.
CPC ..... *G09G 3/006* (2013.01); *G09G 2310/06* (2013.01); *G09G 2310/08* (2013.01)

(58) Field of Classification Search
CPC ..... G09G 2310/06; G09G 2310/08; G09G 2330/12; G09G 3/006
USPC ..... 345/690
See application file for complete search history.

(56) References Cited

U.S. PATENT DOCUMENTS

2005/0277815 A1* 12/2005 Taniguchi ..... A61B 6/461 600/300
2007/0091334 A1* 4/2007 Yamaguchi ..... H04N 9/3182 358/1.9
2008/0297603 A1* 12/2008 Hurst ..... H04N 17/02 348/181
2010/0014846 A1* 1/2010 Nishi ..... G03B 5/00 396/52
2010/0157047 A1* 6/2010 Larkin ..... H04N 9/3191 348/135
2011/0234654 A1* 9/2011 Park ..... H04N 5/44513 345/690
2012/0127324 A1* 5/2012 Dickins ..... G09G 3/006 348/191

FOREIGN PATENT DOCUMENTS

KR 10-0896178 5/2009
KR 10-2015-0082768 7/2015
KR 10-1552826 9/2015
KR 10-1830679 2/2018
KR 10-2018-0047151 5/2018

* cited by examiner

*Primary Examiner* — Tony O Davis
(74) *Attorney, Agent, or Firm* — Polsinelli PC

(57) ABSTRACT

A display device having a test function includes a display panel; and a display driving device configured to store pattern data corresponding to test patterns for testing an image quality of the display panel and control data for controlling the pattern data. The display driving device sets a display order and a display time of each of the test patterns by using the control data, and performs driving such that at least two test patterns are displayed on the display panel depending on the control data.

18 Claims, 6 Drawing Sheets

DISPLAY DRIVING DEVICE HAVING TEST FUNCTION AND DISPLAY DEVICE INCLUDING THE SAME

BACKGROUND

1. Technical Field

Various embodiments generally relate to a display technology, and more particularly, to a display driving device having a test function and a display device including the same.

2. Related Art

A display device includes a display panel, a display driving device and a timing controller. The display driving device converts digital image data into a source driving signal, and provides the source driving signal to the display panel.

The display driving device may include multiple channels corresponding to data lines of the display panel, and each of the multiple channels may include a digital-analog converter which converts digital image data into a source driving signal and an output buffer which outputs the source driving signal to a data line of the display panel.

If the manufacture of the display panel is completed, the display device is inspected for a defect in the pixels of the display panel, is aging-tested for a predetermined period of time to test display characteristics under a severe condition, and is then placed on the market.

Such inspection may be performed in a process of automatically inspecting a defect of the display panel, but there may be a process of inspecting a defect of the display panel with a human eye. In the conventional art, a test pattern for inspecting a defect of the display panel is applied to the display panel through an external test apparatus.

However, in the conventional art, since the test pattern is received from the external test apparatus, an interface condition with the external test apparatus should be considered. As a consequence, a problem may be caused in that a test process is complicated. Also, in the conventional art, because a test method for inspecting a defect of the display panel is fixed, a problem may be caused in that the image quality of the display panel cannot be tested in various methods.

SUMMARY

Various embodiments are directed to a display driving device having a test function, which supports testing of the image quality of a display panel by using various test patterns and methods, and a display device including the same.

In an embodiment, a display device having a test function may include: a display panel; and a display driving device configured to store pattern data corresponding to test patterns for testing an image quality of the display panel and control data for controlling the pattern data. The display driving device may set a display order and a display time of each of the test patterns by using the control data, and may perform driving such that at least two test patterns are displayed on the display panel depending on the control data.

In an embodiment, a display driving device having a test function may include: a storage circuit configured to store pattern data corresponding to test patterns for testing an image quality of a display panel and control data for controlling the pattern data; a data driving circuit configured to provide a source signal corresponding to the pattern data, to the display panel; and a control circuit configured to set a display order and a display time of each of the test patterns by using the control data, and control the data driving circuit such that at least two test patterns are displayed on the display panel depending on the control data when testing an image quality of the display panel.

In an embodiment, a display driving device having a test function may include: a pattern generation circuit configured to receive a command signal, and generate pattern data corresponding to test patterns for testing an image quality of a display panel in correspondence to the command signal; a control circuit configured to receive the pattern data from the pattern generation circuit, set a display order and a display time of each of the test patterns by using control data for controlling the pattern data, and control a data driving circuit such that at least two test patterns are displayed on the display panel depending on the control data when testing an image quality of the display panel.

According to the embodiments of the disclosure, since at least one among the display order, display time, frame frequency, size, shape, color and structure of each of test patterns for testing the image quality of a display panel may be changed, it is possible to test the image quality of a display panel by various test patterns and methods.

Also, since a plurality of test patterns may be simultaneously displayed by adjusting the sizes of test patterns, a test time required for testing aging of a display panel may be reduced.

Further, since pattern data and control data which are internally set and a clock signal which is internally generated are used when testing the image quality of a display panel, the image quality of a display panel may be easily tested without using a separate external test apparatus.

Moreover, since the image quality of a display panel may be tested by various test patterns and methods, a display driving device may be utilized as a test apparatus for verifying and evaluating the quality of a display panel.

In addition, since the display driving device in accordance with the embodiments of the disclosure is able to internally generate pattern data corresponding to various test patterns, the image quality of a display panel may be tested by various test patterns and methods. Thus, the display driving device may be utilized as a test apparatus for verifying and evaluating the quality of a display panel.

DETAILED DESCRIPTION

Figure 1:
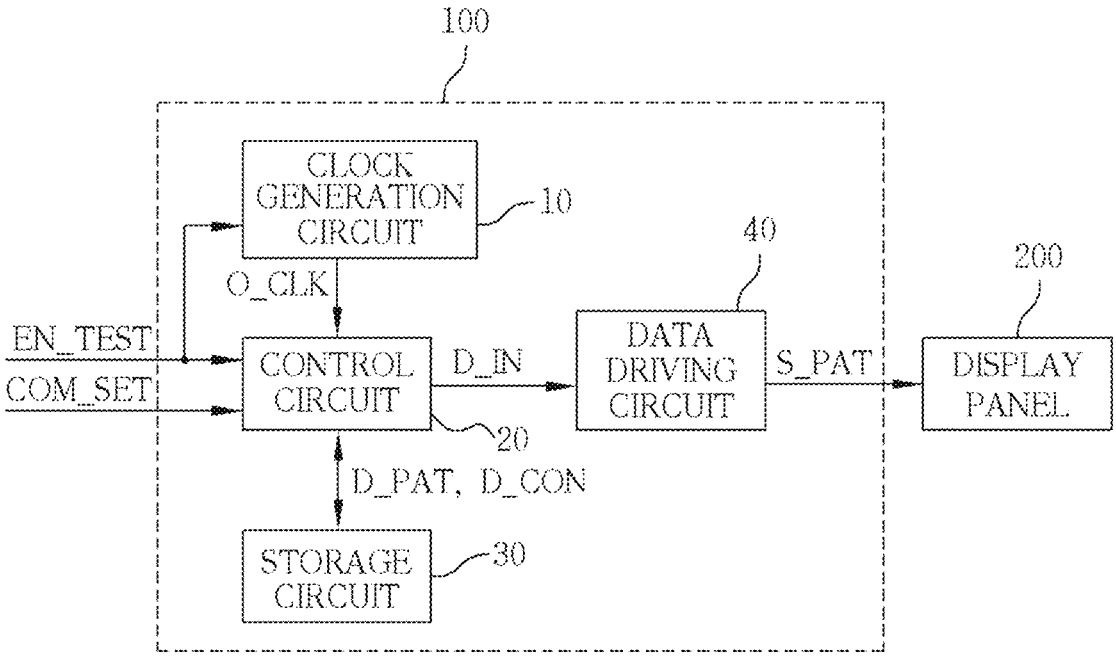
FIG. 1 is a diagram illustrating a representation of an example of a display driving device having a test function and a display device including the same in accordance with an embodiment of the disclosure.

Hereinafter, embodiments of the disclosure will be described in detail with reference to the accompanying drawings. The terms used herein and in the claims shall not be construed by being limited to general or dictionary meanings and shall be interpreted based on the meanings and concepts corresponding to technical aspects of the disclosure.

Embodiments described herein and configurations illustrated in the drawings are preferred embodiments of the disclosure, and, because they do not represent all of the technical features of the disclosure, there may be various equivalents and modifications that can be made thereto at the time of the present application.

An embodiment of the disclosure provides a display driving device having a built-in self test function capable of testing the image quality of a display panel by various test patterns and methods through changing the display order, display time, frame frequency, size, shape, color and structure of each of test patterns for testing the image quality of a display panel.

FIG. 1 is a diagram illustrating a representation of an example of a display driving device 100 having a test function and a display device including the same in accordance with an embodiment of the disclosure.

Referring to FIG. 1, the display device includes the display driving device 100 and a display panel 200. The display driving device 100 includes a clock generation circuit 10, a control circuit 20, a storage circuit 30 and a data driving circuit 40.

The storage circuit 30 stores pattern data D_PAT and control data D_CON. The pattern data D_PAT may be defined as data corresponding to test patterns for testing the image quality of the display panel 200, and the control data D_CON may be defined as data corresponding to a display condition including at least one among the display order, display time, frame frequency, size, shape, color and structure of each of the test patterns. For instance, the storage circuit 30 may be configured by an EEPROM.

The control data D_CON stored in the storage circuit 30 may be changed by setting signals COM_SET which are applied to the control circuit 20. The setting signals COM_SET may be defined as command signals for changing and setting the display order, display time, frame frequency, size, shape, color and structure of each of the test patterns, which are provided from an external terminal. That is to say, the display order, display time, frame frequency, size, shape, color and structure of each of the test patterns may be changeably adjusted.

Figure 2:
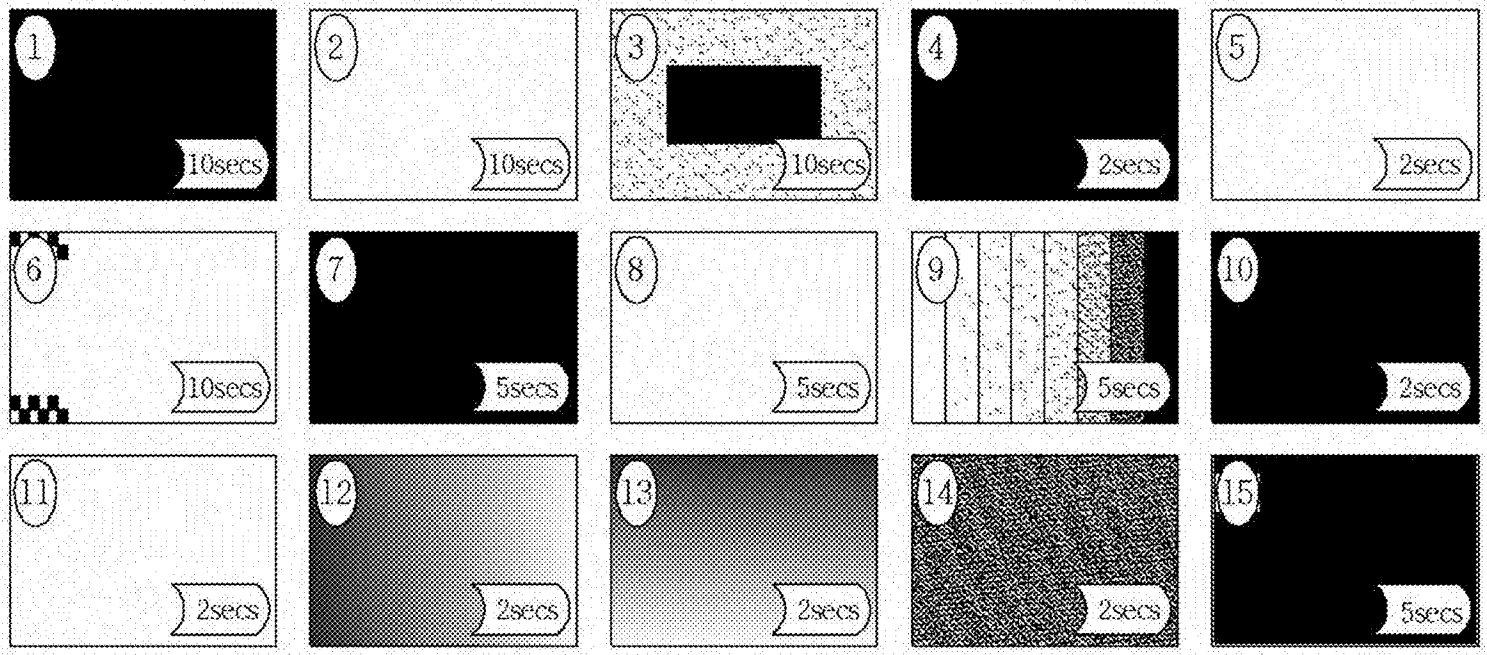
FIG. 2 is a representation of an example of test patterns displayed on a display panel in accordance with the embodiment of the disclosure.

For instance, referring to FIG. 2, test patterns which are used in testing the image quality of the display panel 200 may include a black pattern, a white pattern, a color bar pattern, a horizontal 256 gray pattern, a vertical 256 gray pattern, a crosstalk pattern, a dot pattern, and a black background pattern with white 1 outline frame. The above test patterns may be applied to the display panel 200 and be used in detecting a failure such as an afterimage and a flicker.

The clock generation circuit 10 receives a test signal EN_TEST, generates a clock signal O_CLK when the test signal EN_TEST is enabled, and provides the clock signal O_CLK to the control circuit 20. The test signal EN_TEST may be defined as a signal which is enabled when testing the image quality of the display panel 200. For instance, the clock generation circuit 10 may include an oscillator (not shown) which generates the clock signal O_CLK when the test signal EN_TEST is enabled, and a transfer circuit (not shown) which transfers the clock signal O_CLK to the control circuit 20.

The control circuit 20 may receive the setting signals COM_SET, and may set the display order, display time, frame frequency, size, shape, color and structure of each of test patterns, by changing the control data D_CON stored in the storage circuit 30, depending on the setting signals COM_SET. The setting signals COM_SET may be defined as command signals for changing and setting the display order, display time, frame frequency, size, shape, color and structure of each of the test patterns, which are provided from an external terminal.

The control circuit 20 receives the test signal EN_TEST, reads the pattern data D_PAT and the control data D_CON from the storage circuit 30 when the test signal EN_TEST is enabled, and provides an input signal D_IN including the clock signal O_CLK, the pattern data D_PAT and the control data D_CON, to the data driving circuit 40. The control circuit 20 controls the data driving circuit 40 such that test patterns are displayed on the display panel 200 depending on the control data D_CON which defines the display order, display time, frame frequency, size, shape, color and structure of each of test patterns.

While it is described in the present embodiment that the control circuit 20 is disposed in the display driving device 100, it is to be noted that the control circuit 20 may be disposed outside the display driving device 100. In a general operation such as when the test signal EN_TEST is disabled, the control circuit 20 may receive an image and control data which are provided from a host, and may control the data driving circuit 40 by using the image and the control data such that image data is displayed on the display panel 200.

The data driving circuit 40 converts the pattern data D_PAT into a source signal S_PAT in response to the clock signal O_CLK of the clock generation circuit 10, and provides the source signal S_PAT to the display panel 200. For instance, the data driving circuit 40 may include a latch circuit (not shown) which latches the pattern data D_PAT, may include a digital-analog circuit (not shown) which converts the pattern data D_PAT as a digital signal into the source signal S_PAT as an analog signal, and may include an output buffer circuit (not shown) which buffers the source signal S_PAT and provides the buffered source signal S_PAT to the display panel 200.

Meanwhile, as another embodiment, the storage circuit 30 may store the pattern data D_PAT and the control data D_CON corresponding to a plurality of test modes, and the control circuit 20 may be configured to select at least one test mode among the plurality of test modes in response to the setting signals COM_SET. In each of the plurality of test modes, at least one of the display order, display time, frame frequency, size, shape, color and structure of each of test patterns may be set differently, and the control circuit 20 may provide the pattern data D_PAT and the control data D_CON corresponding to a selected test mode, to the data driving circuit 40.

In the meantime, as another embodiment, the control circuit 20 may generate test patterns by using the setting signals COM_SET corresponding to command signals. The setting signals COM_SET may include a command for designating pattern generators, a command for designating regions (sizes) of test patterns, and commands for designating colors, gradations and gradation stages for the regions. The control circuit 20 may generate the pattern data D_PAT corresponding to test patterns by designating at least one among regions of the test patterns, and colors, gradations and gradation stages for the regions in response to the setting signals COM_SET, and may store the pattern data D_PAT in the storage circuit 30.

FIG. 2 is a representation of an example of test patterns displayed on a display panel in accordance with the embodiment of the disclosure.

FIG. 2 shows that test patterns are displayed as display orders and display times are set to a black pattern of 10 seconds, a white pattern of 10 seconds, a crosstalk pattern of 3 seconds, a black pattern of 2 seconds, a white pattern of 2 seconds, a dot pattern of 20 seconds, a black pattern of 5 seconds, a white pattern of 5 seconds, a color bar pattern of 5 seconds, a black pattern of 2 seconds, a white pattern of 2 seconds, a vertical gray pattern of 2 seconds, a horizontal gray pattern of 2 seconds, a blue pattern of 2 seconds and a black background pattern of 5 seconds.

The pattern data D_PAT corresponding to the above test patterns may be stored in the storage circuit 30, and the display order and the display time of each of the test patterns may be controlled by the control data D_CON. While not shown in FIG. 2, the frame frequency of each of the test patterns displayed on the display panel 200 may be controlled by the control data D_CON. The above test patterns required in the display panel 200 may be used in detecting a failure such as an afterimage and a flicker.

As is apparent from the above descriptions, since the display driving device 100 in accordance with the present embodiment is able to change the display order, display time and frame frequency of each of test patterns, it is possible to test the image quality of a display panel by various test patterns and methods. As a consequence, since the display driving device 100 in accordance with the present embodiment has a built-in self test function, the display driving device 100 may be utilized as a test apparatus for verifying and evaluating a display panel.

Figure 3:
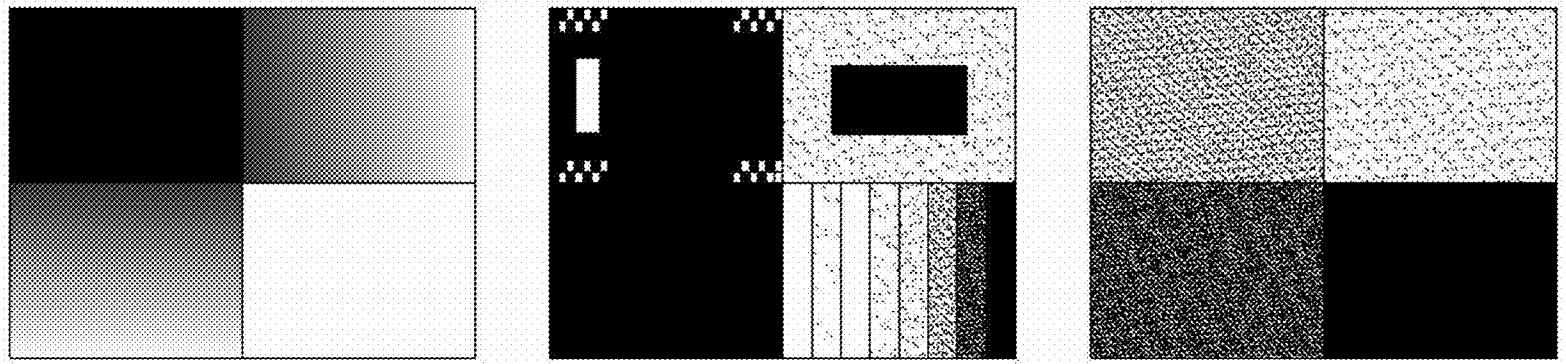
FIGS. 3 and 4 are representations of examples of resized test patterns in accordance with the embodiment of the disclosure.
Figure 4:
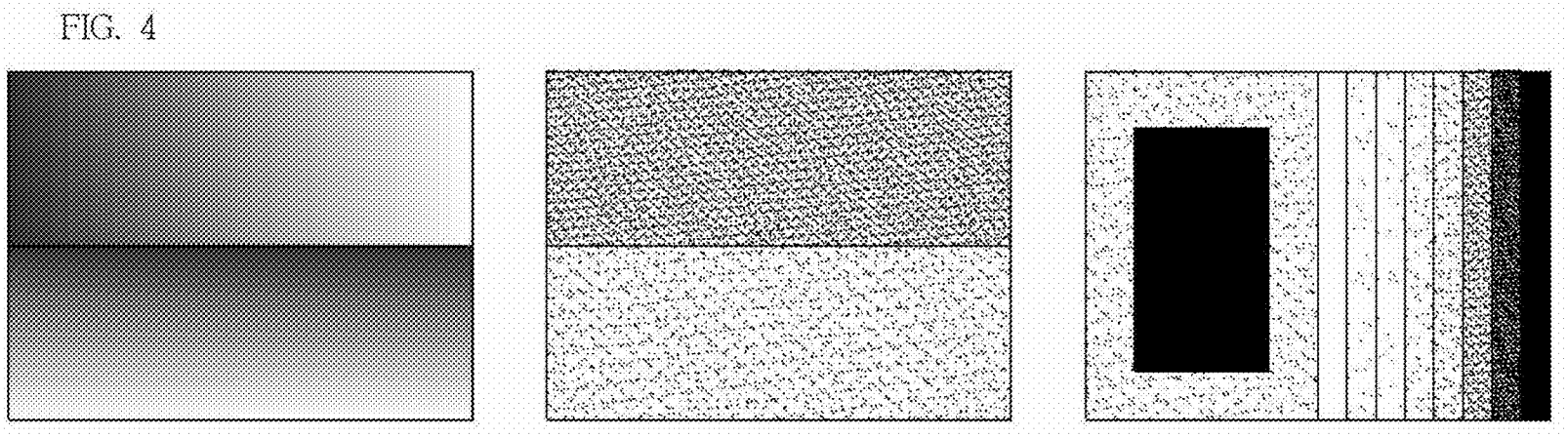

FIGS. 3 and 4 are representations of examples of resized test patterns in accordance with the embodiment of the disclosure.

FIG. 3 shows that the sizes of test patterns are adjusted and four test patterns are simultaneously displayed on a display panel. The first figure shows that a black pattern, a vertical gray pattern, a horizontal gray pattern and a white pattern are simultaneously displayed by being adjusted to a ¼ size, the second figure shows that a dot pattern, a crosstalk pattern, a black pattern and a color bar pattern are simultaneously display by being adjusted to a ¼ size, and the third figure shows that a red pattern, a green pattern, a blue pattern and a black pattern are simultaneously displayed by being adjusted to a ¼ size.

FIG. 4 shows that the sizes of test patterns are adjusted and two test patterns are simultaneously displayed on a display panel. The first figure shows that a vertical gray pattern and a horizontal gray pattern are simultaneously displayed by being adjusted to a ½ size, the second figure shows that a red pattern and a green pattern are simultaneously displayed by being adjusted to a ½ size, and the third figure shows that a crosstalk pattern and a color bar pattern are simultaneously displayed by being adjusted to a ½ size.

As is apparent from the above descriptions, since the display driving device 100 in accordance with the present embodiment simultaneously displays a plurality of test patterns by adjusting the sizes of the test patterns, a test time required for testing the image quality of a display panel such as aging may be reduced.

Figure 5:
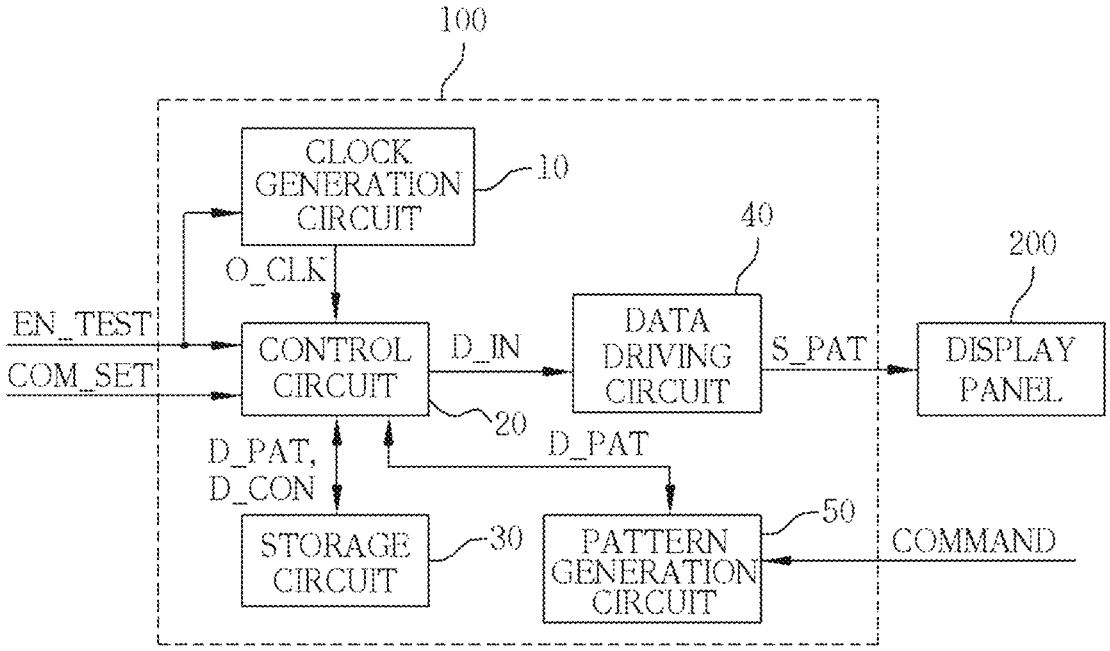
FIG. 5 is a diagram illustrating a representation of an example of a display driving device having a test function in accordance with another embodiment of the disclosure.
Figure 6:
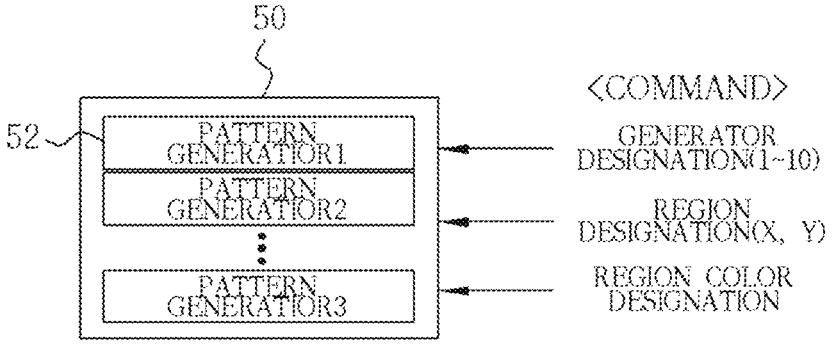
FIG. 6 is a representation of an example of a diagram to assist in the explanation of the pattern generation circuit illustrated in FIG. 5.
Figure 7:
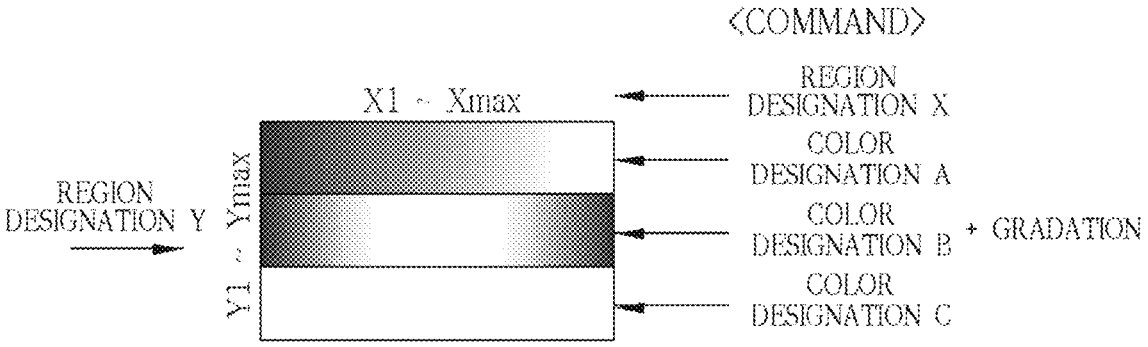
FIG. 7 is a representation of an example of a diagram to assist in the explanation of the operation of the pattern generation circuit illustrated in FIG. 5, for generating test patterns.

FIG. 5 is a diagram illustrating a representation of an example of a display driving device 100 having a test function in accordance with another embodiment of the disclosure, FIG. 6 is a representation of an example of a diagram to assist in the explanation of a pattern generation circuit 50 illustrated in FIG. 5, and FIG. 7 is a representation of an example of a diagram to assist in the explanation of the operation of the pattern generation circuit 50 illustrated in FIG. 5, for generating test patterns.

Referring to FIGS. 5 to 7, the display driving device 100 may include the pattern generation circuit 50 which receives a command signal COMMAND from an exterior and generates pattern data D_PAT corresponding to test patterns for testing the image quality of a display panel 200, in response to the command signal COMMAND. While it is illustrated in the embodiment of FIG. 5 that the pattern generation circuit 50 receives the command signal COMMAND, it may be envisaged that a control circuit 20 may be configured to receive setting signals COM_SET corresponding to a command signal and provide the command signal to the pattern generation circuit 50.

Referring to FIGS. 6 and 7, the pattern generation circuit 50 may include a plurality of pattern generators 52 which generate corresponding test patterns according to the command signal COMMAND. The command signal COMMAND may include a command for designating the plurality of pattern generators 52, a command for designating regions (sizes) of test patterns, and commands for designating colors, gradations and gradation stages for the regions.

The pattern generation circuit 50 may generate the pattern data D_PAT corresponding to test patterns by designating at least one among regions of the test patterns, and colors, gradations and gradation stages for the regions in correspondence to the command signal COMMAND, and may provide the pattern data D_PAT to the control circuit 20, as shown in FIGS. 5 to 7. While it is illustrated in the embodiment of FIG. 5 that the pattern generation circuit 50 provides the pattern data D_PAT to the control circuit 20, it may be envisaged that the pattern generation circuit 50 may store the pattern data D_PAT in a storage circuit 30. Alternatively, the control circuit 20 may store the pattern data D_PAT provided from the pattern generation circuit 50, in the storage circuit 30.

The control circuit 20 may receive the pattern data D_PAT from the pattern generation circuit 50, may set at least one among the display order, display time and frame frequency of each of test patterns, and may control a data driving circuit 40 such that test patterns are displayed under a set condition when testing the image quality of the display panel 200.

The storage circuit 30 may store the pattern data D_PAT generated from the pattern generation circuit 50 and control data D_CON for controlling the pattern data D_PAT.

The control circuit 20 may receive the setting signals COM_SET, and may set at least one among the display order, display time and frame frequency of each of test patterns, by changing the control data D_CON of the storage circuit 30 depending on the setting signals COM_SET.

As is apparent from the above descriptions, since the display driving device 100 in accordance with the present embodiment is able to internally generate the pattern data D_PAT corresponding to various test patterns, depending on a user's command, it is possible to test the image quality of a display panel by various test patterns and methods. Thus, the display driving device 100 may be utilized as a test apparatus for verifying and evaluating the quality of a display panel.

While various embodiments have been described above, it will be understood to those skilled in the art that the embodiments described are by way of example only. Accordingly, the disclosure described herein should not be limited based on the described embodiments.

What is claimed is:

1. A display device having a test function, comprising:

a display panel; and a display driving device for driving the display panel, where the display driving device comprises:

a storage unit configured to store pattern data corresponding to test patterns for testing an image quality of the display panel and control data for controlling the pattern data;

a data driving circuit configured to provide a source signal corresponding to the pattern data, to the display panel;

a control circuit configured to set a display order and a display time of each of the test patterns by using the control data, and control the data driving circuit such that at least two test patterns are displayed on the display panel depending on the control data; and a pattern generation circuit configured to receive a command signal, and generate the pattern data by designating at least one among regions of the test patterns and colors, gradations and gradation stages for the regions, in correspondence to the command signal, wherein the command signal comprises commands for designating a plurality of pattern generators, regions of the test patterns and colors for the regions.

2. The display device according to claim 1, wherein the display driving device receives a test signal, and performs control such that the test patterns are displayed on the display panel depending on the control data when the test signal is enabled.

3. The display device according to claim 1, wherein the display driving device receives setting signals, and sets at least one among a display order, a display time, a frame frequency, a size, a shape, a color and a structure of each of the test patterns by changing the control data depending on the setting signals.

4. The display device according to claim 1, wherein the control circuit sets at least one among a display order, a display time, a frame frequency, a size, a shape, a color and a structure of each of the test patterns by changing the control data depending on setting signals.

5. The display device according to claim 4, wherein the control circuit receives a test signal, reads the pattern data and the control data from the storage circuit when the test signal is enabled, and controls the data driving circuit such that the test patterns are displayed on the display panel depending on the control data.

6. The display device according to claim 4, wherein the control circuit receives the setting signals, and sets a display order, a display time, a frame frequency, a size, a shape, a color and a structure of each of the test patterns by changing the control data depending on the setting signals.

7. The display device according to claim 1, further comprising:

a clock generation circuit configured to receive a test signal and provide a clock signal to the control circuit when the test signal is enabled.

8. The display device according to claim 7, wherein the control circuit provides an input signal which includes the clock signal, the pattern data and the control data, to the data driving circuit when the test signal is enabled.

9. A display driving device having a test function, comprising:

a storage circuit configured to store pattern data corresponding to test patterns for testing an image quality of a display panel and control data for controlling the pattern data;

a data driving circuit configured to provide a source signal corresponding to the pattern data, to the display panel;

a control circuit configured to set a display order and a display time of each of the test patterns by using the control data, and control the data driving circuit such that at least two test patterns are displayed on the display panel depending on the control data when testing an image quality of the display panel; and a pattern generation circuit configured to receive a command signal, and generate the pattern data by designating at least one among regions of the test patterns and colors, gradations and gradation stages for the regions, in correspondence to the command signal, wherein the command signal comprises commands for designating a plurality of pattern generators, regions of the test patterns and colors for the regions.

10. The display driving device according to claim 9, wherein the control circuit receives a test signal, and controls the data driving circuit such that the test patterns are displayed on the display panel when the test signal is enabled.

11. The display driving device according to claim 9, wherein the control circuit receives setting signals, and sets at least one among a display order, a display time, a frame frequency, a size, a shape, a color and a structure of each of the test patterns by changing the control data depending on the setting signals.

12. The display driving device according to claim 9, further comprising:

a clock generation circuit configured to receive a test signal and provide a clock signal to the control circuit when the test signal is enabled.

13. The display driving device according to claim 9, wherein the control circuit provides an input signal which includes the clock signal, the pattern data and the control data, to the data driving circuit when the test signal is enabled.

14. The display driving device according to claim 9, wherein the storage circuit stores the pattern data and the control data corresponding to a plurality of test modes, and the control circuit receives setting signals and selects at least one test mode among the plurality of test modes in response to the setting signals.

15. A display driving device having a test function, comprising:

a pattern generation circuit configured to receive a command signal, and generate pattern data corresponding to test patterns for testing an image quality of a display panel in correspondence to the command signal;

a control circuit configured to receive the pattern data from the pattern generation circuit, set a display order and a display time of each of the test patterns by using control data for controlling the pattern data, and control a data driving circuit such that at least two test patterns are displayed on the display panel depending on the control data when testing an image quality of the display panel, wherein the pattern generation circuit comprises a plurality of pattern generators which generate corresponding test patterns depending on the command signal, wherein the command signal comprises commands for designating the plurality of pattern generators, regions of the test patters and colors for the regions.

16. The display driving device according to claim 15, wherein the pattern generation circuit generates the test patterns by designating at least one among regions of the test patterns and colors, gradations and gradation stages for the regions, in correspondence to the command signal.

17. The display driving device according to claim 15, wherein further comprising:

a storage circuit configured to store the pattern data generated from the pattern generation circuit and control data for controlling the pattern data.

18. The display driving device according to claim 17, wherein the control circuit receives setting signals, and sets at least one among a display order, a display time, a frame frequency, a size, a shape, a color and a structure of each of the test patterns by changing the control data depending on the setting signals.

* * * * *